US011067076B2

(12) United States Patent
Klassen

(10) Patent No.: US 11,067,076 B2
(45) **Date of Patent: *Jul. 20, 2021**

(54) FLUID TRANSFER DEVICE

(71) Applicant: Genesis Advanced Technology Inc., Langley (CA)

(72) Inventor: James Klassen, Langley (CA)

(73) Assignee: GENESIS ADVANCED TECHNOLOGY INC., Langley (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/126,867

(22) Filed: Sep. 10, 2018

(65) Prior Publication Data

US 2020/0011329 A1 Jan. 9, 2020

Related U.S. Application Data

(63) Continuation of application No. 14/779,004, filed on Sep. 21, 2015, now Pat. No. 10,072,656.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/10*** | (2006.01) |
| ***F04D 7/04*** | (2006.01) |
| ***F04D 29/62*** | (2006.01) |
| ***F04D 29/42*** | (2006.01) |

(Continued)

(52) U.S. Cl.

CPC ..... *F04C 2/102* (2013.01); *F04C 2/084* (2013.01); *F04C 2/101* (2013.01); *F04C 23/001* (2013.01); *F04D 7/045* (2013.01); *F04D 29/2288* (2013.01); *F04D 29/4286* (2013.01); *F04D 29/62* (2013.01); *F04C 13/001* (2013.01); *F04C 2210/24* (2013.01); *F04C 2240/70* (2013.01)

(58) Field of Classification Search

CPC ..... F04C 2/084; F04C 2/101; F04C 2/102; F04C 13/001; F04C 23/001; F04C 2240/70; F04C 14/04; F04D 29/4286; F04D 29/62; F04D 29/2288; F04D 7/045

USPC ..... 418/5, 9, 166, 169–171, 189–190, 32

See application file for complete search history.

(56) References Cited

U.S. PATENT DOCUMENTS 1,773,211 A 8/1930 Wilsey
1,972,565 A 9/1934 Kempton (Continued)

FOREIGN PATENT DOCUMENTS

WO 02/063140 A2 8/2002

*Primary Examiner* — Theresa Trieu

(74) *Attorney, Agent, or Firm* — Seed Intellectual Property Law Group LLP

(57) ABSTRACT

In a rotor in rotor configuration, a pump has inward projections on an outer rotor and outward projections on an inner rotor. The outer rotor is driven and the projections mesh to create variable volume chambers. The outer rotor may be driven in both directions. In each direction, the driving part (first inward projection) of the outer rotor contacts a sealing surface on one side of an outward projection of the inner rotor, while a gap is left between a sealing surface of the other side of the outward projection and a second inward projection. The gap may have uniform width along its length in the radial direction, while in a direction parallel to the rotor axis it may be discontinuous or have variable size to create flow paths for gases.

11 Claims, 11 Drawing Sheets

(51) Int. Cl.

| | |
|---|---|
| ***F04D 29/22*** | (2006.01) |
| ***F04C 2/08*** | (2006.01) |
| ***F04C 23/00*** | (2006.01) |
| *F04C 13/00* | (2006.01) |

(56) References Cited

U.S. PATENT DOCUMENTS

| | | | | | |
|---|---|---|---|---|---|
| 2,294,798 | A | | 9/1942 | Nelson | |
| 2,871,793 | A | | 2/1959 | Michie et al. | |
| 3,026,810 | A | | 3/1962 | Kubiak et al. | |
| 3,096,720 | A | | 7/1963 | Younger | |
| 3,551,081 | A | | 12/1970 | Brundage | |
| 3,810,721 | A | * | 5/1974 | Eyer | F04C 2/101 418/170 |
| 3,850,150 | A | | 11/1974 | Plevyak | |
| 3,958,494 | A | | 5/1976 | Miller | |
| 3,981,646 | A | * | 9/1976 | Bottoms | F04C 2/084 418/190 |
| 4,145,167 | A | | 3/1979 | Baatrup | |
| RE31,418 | E | * | 10/1983 | Tschritter | F04C 2/101 418/169 |
| 4,932,850 | A | | 6/1990 | Valavaara | |
| 4,958,996 | A | | 9/1990 | Janssen et al. | |
| 4,971,528 | A | | 11/1990 | Hodgkins et al. | |
| 4,984,975 | A | * | 1/1991 | Thompson | F04C 2/084 418/181 |
| 5,165,868 | A | | 11/1992 | Gergets et al. | |
| 5,658,138 | A | * | 8/1997 | Round | F04C 2/102 418/171 |
| 5,660,531 | A | | 8/1997 | Merkle et al. | |
| 5,753,108 | A | | 5/1998 | Haynes et al. | |
| 6,113,360 | A | | 9/2000 | Yu et al. | |
| 6,280,167 | B1 | | 8/2001 | Pahl et al. | |
| 6,672,275 | B2 | * | 1/2004 | Duncan | F01C 1/102 418/166 |
| 6,896,500 | B2 | | 5/2005 | Ike et al. | |
| 7,008,200 | B2 | | 3/2006 | Holtzapple et al. | |
| 7,014,436 | B2 | * | 3/2006 | Klassen | F04C 2/101 418/170 |
| 7,111,606 | B2 | * | 9/2006 | Klassen | F04C 2/102 418/171 |
| 7,182,860 | B2 | | 2/2007 | Lundin | |
| 7,185,625 | B1 | | 3/2007 | Guan et al. | |
| 7,479,000 | B2 | * | 1/2009 | Klassen | F04C 2/084 418/190 |
| 7,695,260 | B2 | | 4/2010 | Holtzapple et al. | |
| 7,726,959 | B2 | | 6/2010 | Holtzapple et al. | |
| 7,922,468 | B2 | | 4/2011 | Chang | |
| 8,118,579 | B2 | | 2/2012 | Klassen | |
| 10,072,656 | B2 | * | 9/2018 | Klassen | F04C 2/102 418/171 |
| 2004/0175274 | A1 | | 9/2004 | Cho et al. | |
| 2006/0193741 | A1 | | 8/2006 | Wanschura et al. | |
| 2007/0251491 | A1 | | 11/2007 | Klassen et al. | |
| 2009/0142208 | A1 | | 6/2009 | Rhein et al. | |
| 2009/0159040 | A1 | * | 6/2009 | Klassen | F01C 1/084 123/241 |
| 2010/0322810 | A1 | | 12/2010 | Schepp et al. | |
| 2011/0041144 | A1 | | 2/2011 | Araki | |
| 2011/0200477 | A1 | * | 8/2011 | Chua | F04C 2/102 418/171 |
| 2013/0071280 | A1 | * | 3/2013 | Klassen | F04C 2/00 418/196 |

* cited by examiner

FLUID TRANSFER DEVICE

CROSS-REFERENCE TO RELATED APPLICATIONS

This application claims the benefit under 35 USC 120 of U.S. non-provisional application Ser. No. 14/779,004 filed Sep. 21, 2015.

TECHNICAL FIELD

Pumps.

BACKGROUND

Fluid transfer devices with a rotor in rotor configuration are known from U.S. Pat. Nos. 7,111,606 and 7,479,000. However, these devices are not particularly designed for use in slurry pumping where the slurry might include breakable particulates.

SUMMARY

In an embodiment of a rotor in rotor configuration, a pump has inward projections on an outer rotor and outward projections on an inner rotor. The outer rotor is driven and the projections mesh to create variable volume chambers. The outer rotor may be driven in both directions. In each direction, the driving part (first inward projection) of the outer rotor is sealed to by contact with or sealing proximity to a sealing surface on one side of an outward projection of the inner rotor, while a gap is left between a sealing surface of the other side of the outward projection and a second inward projection. The gap may have uniform width along its length in the radial direction, while in a direction parallel to the rotor axis it may be discontinuous or have variable size to create flow paths for gases.

Thus, in one embodiment there is disclosed a fluid transfer device comprising a housing having an inward facing surface, an outer rotor secured for rotation about an outer rotor axis that is fixed in relation to the housing, the outer rotor having inward projections, the outer rotor being arranged to be driven in operation by a drive shaft, an inner rotor secured for rotation about an inner rotor axis that is fixed in relation to the housing, the inner rotor axis being inside the outer rotor, the inner rotor having outward projections, the outward projections in operation meshing with the inward projections to define variable volume chambers as the inner rotor and outer rotor rotate, fluid transfer passages in a portion of the housing to permit flow of fluid into and out of the variable volume chambers; and each outward projection having a first sealing surface and a second sealing surface circumferentially opposed to each other for respective engagement with corresponding sealing surfaces of adjacent inward projections such that in an operational configuration in which the outer rotor is driven in a first direction, the first sealing surface seals against a first corresponding inward projection with a first continuous gap between at least part of the second sealing surface and a second corresponding inward projection and when the outer rotor is driven in a second direction opposed to the first direction, the second sealing surface seals against the second corresponding inward projection with a second continuous gap between at least part of the first sealing surface and the first corresponding inward projection.

In a further embodiment, there is provided a fluid transfer device comprising a housing having an inward facing surface, an outer rotor secured for rotation about an outer rotor axis that is fixed in relation to the housing, the outer rotor having inward projections, the outer rotor being arranged to be driven in operation by a drive shaft, an inner rotor secured for rotation about an inner rotor axis that is fixed in relation to the housing, the inner rotor axis being inside the outer rotor, the inner rotor having outward projections, the outward projections in operation meshing with the inward projections to define variable volume chambers as the inner rotor and outer rotor rotate, fluid transfer passages in a portion of the housing to permit flow of fluid into and out of the variable volume chambers; and each outward projection having a lateral width and a trailing face and a leading face, and at least one or both of the trailing face and leading face is discontinuous across at least a portion of the lateral width of the outward projection.

In various embodiments, there may be included any one or more of the features set forward in the claims or disclosed herein.

BRIEF DESCRIPTION OF THE FIGURES

Embodiments will now be described with reference to the figures, in which like reference characters denote like elements, by way of example, and in which:

FIG. 4A is a simplified top view of an embodiment of the present invention with no casing (fasteners not shown in any views), while

DETAILED DESCRIPTION

Figure 1:
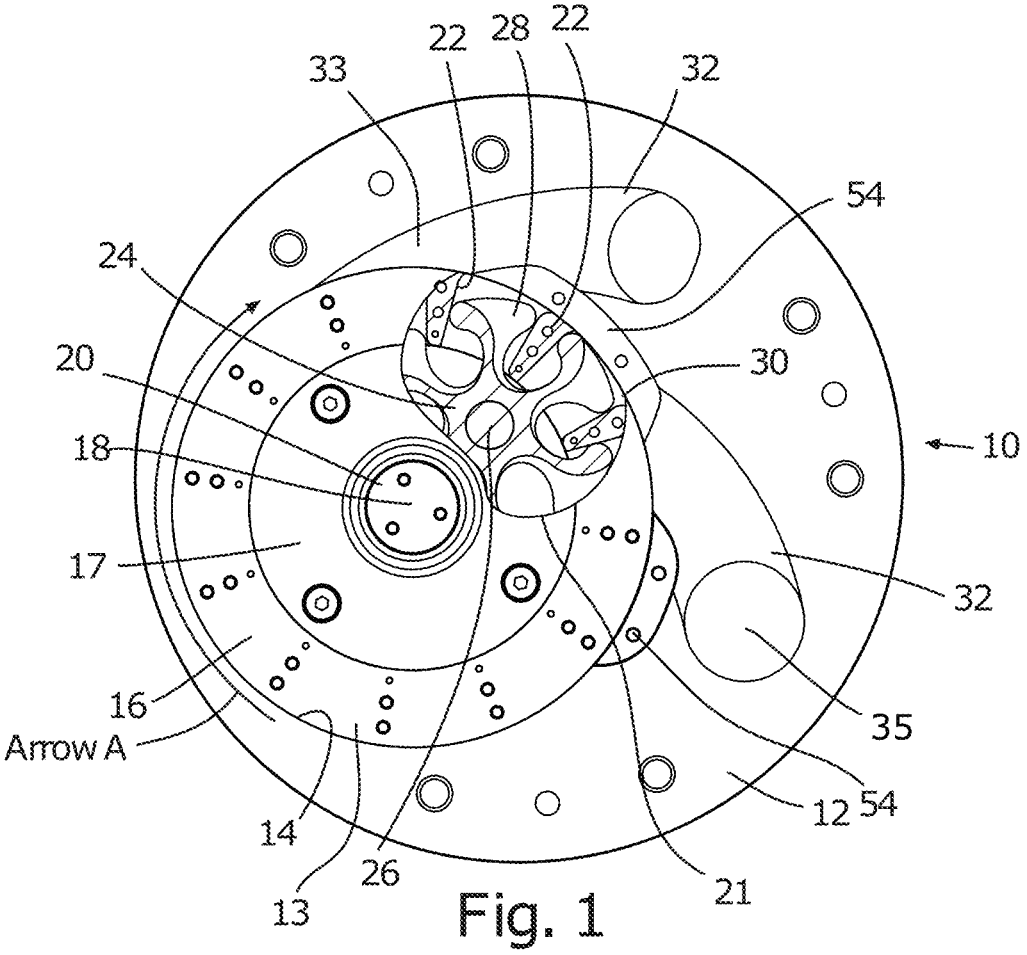
FIG. 1 is a simplified top view of a prototype configuration of an embodiment of the present invention with transparent casing, in which the arrow shows the rotational direction of the rotors when operated as a pump (as a hydraulic motor, rotation would be in the opposite direction)
Figure 10:
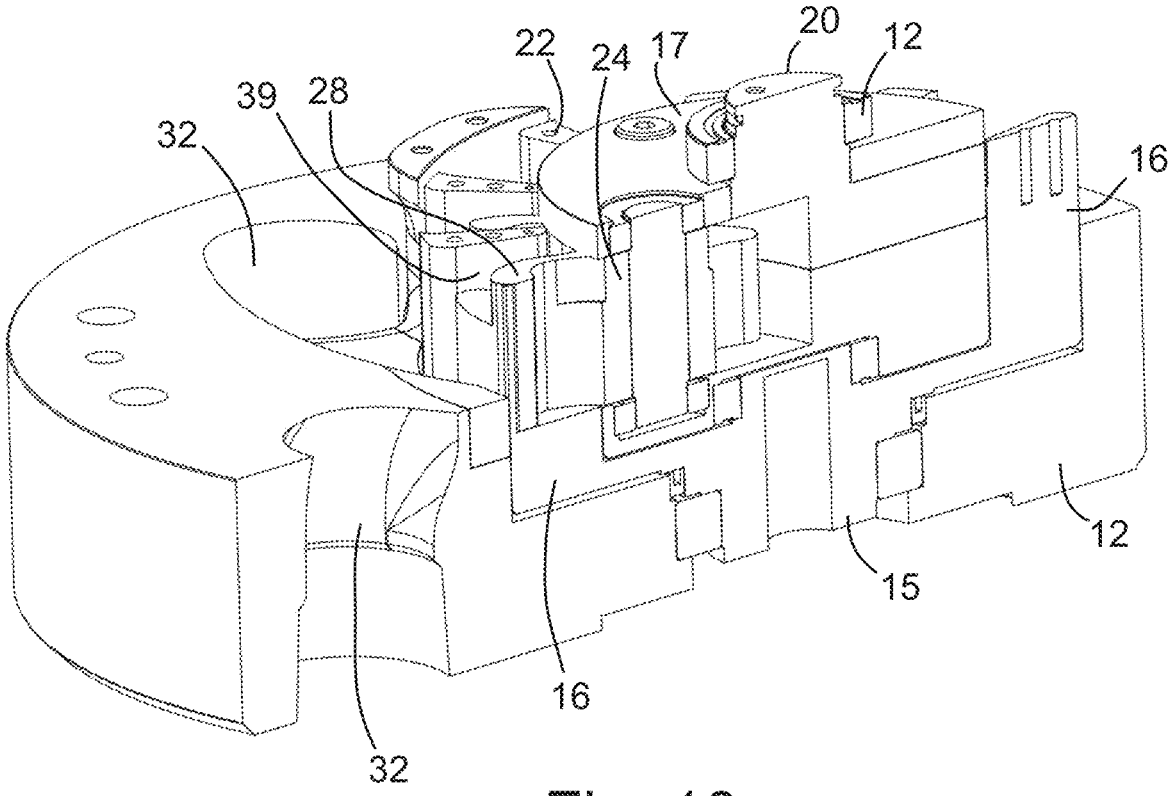
FIG. 10 shows a section through an embodiment of a fluid transfer device.

Referring to FIGS. 1-4, there is shown a fluid transfer device 10 comprising a housing 12 having an inward facing surface 14. The inward facing surface 14 defines a surface of revolution in which an outer rotor 16 rotates. The outer rotor 16 is secured for rotation about an outer rotor axis 18 that is fixed in relation to the housing 12. The outer rotor axis 18 may be defined by a drive shaft (not shown in FIG. 1 but see item 15 in FIG. 10). Shaft 20 may be inserted in a portion of the housing that extends around the outer rotor 16 either directly or indirectly with intervening parts. The outer rotor 16 has inward projections 22. The outer rotor 16 is arranged to be driven in operation by a drive shaft 15 (FIG. 10), which may be connected to a power source (not shown). The outer rotor 16 as shown in FIG. 1 is covered by a casing 13 that forms part of the outer rotor 12.

An inner rotor 24 is secured for rotation about an inner rotor axis 26 that is fixed in relation to the housing 12 by any suitable means as for example by being secured to a casing 17 forming part of the housing. In the embodiment of FIG. 1, the outer rotor has a plate or casing 13 that is cut away at 21 to show the inner rotor 24. The inner rotor axis 26 is located inside the outer rotor 16 (rotor in rotor configuration). The inner rotor 24 has outward projections 28. The outward projections 28 in operation mesh with the inward projections 22 to define variable volume chambers 30 as the inner rotor 24 and outer rotor 16 rotate.

Fluid transfer passages 32 are provided in a portion of the housing 12 to permit flow of fluid into and out of the variable volume chambers 30.

Figure 1B:
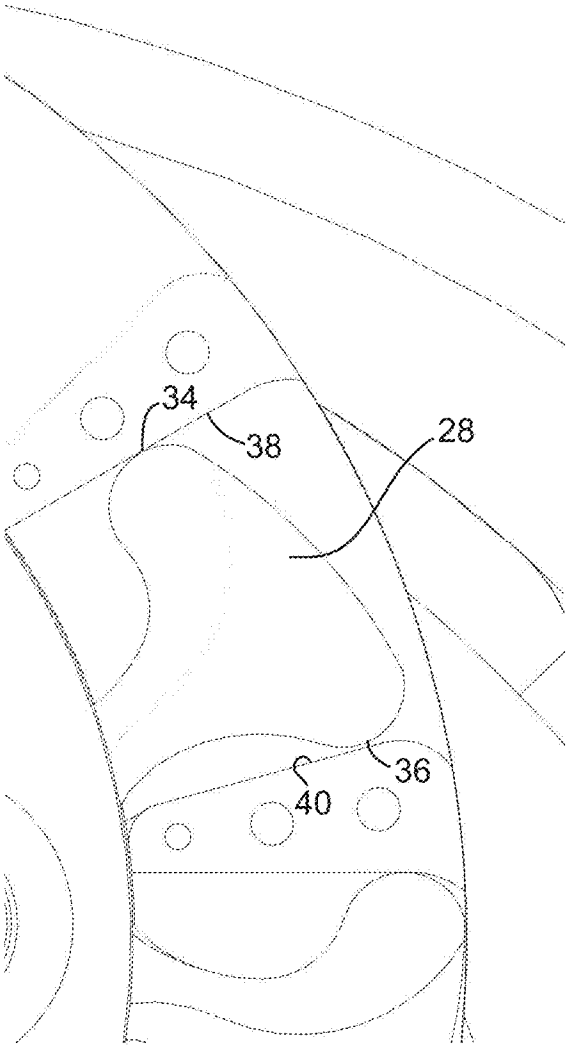
FIGS. 1A, 1B and 1C show exemplary inner rotor configurations in relation to outer rotor projections.
Figure 4A:
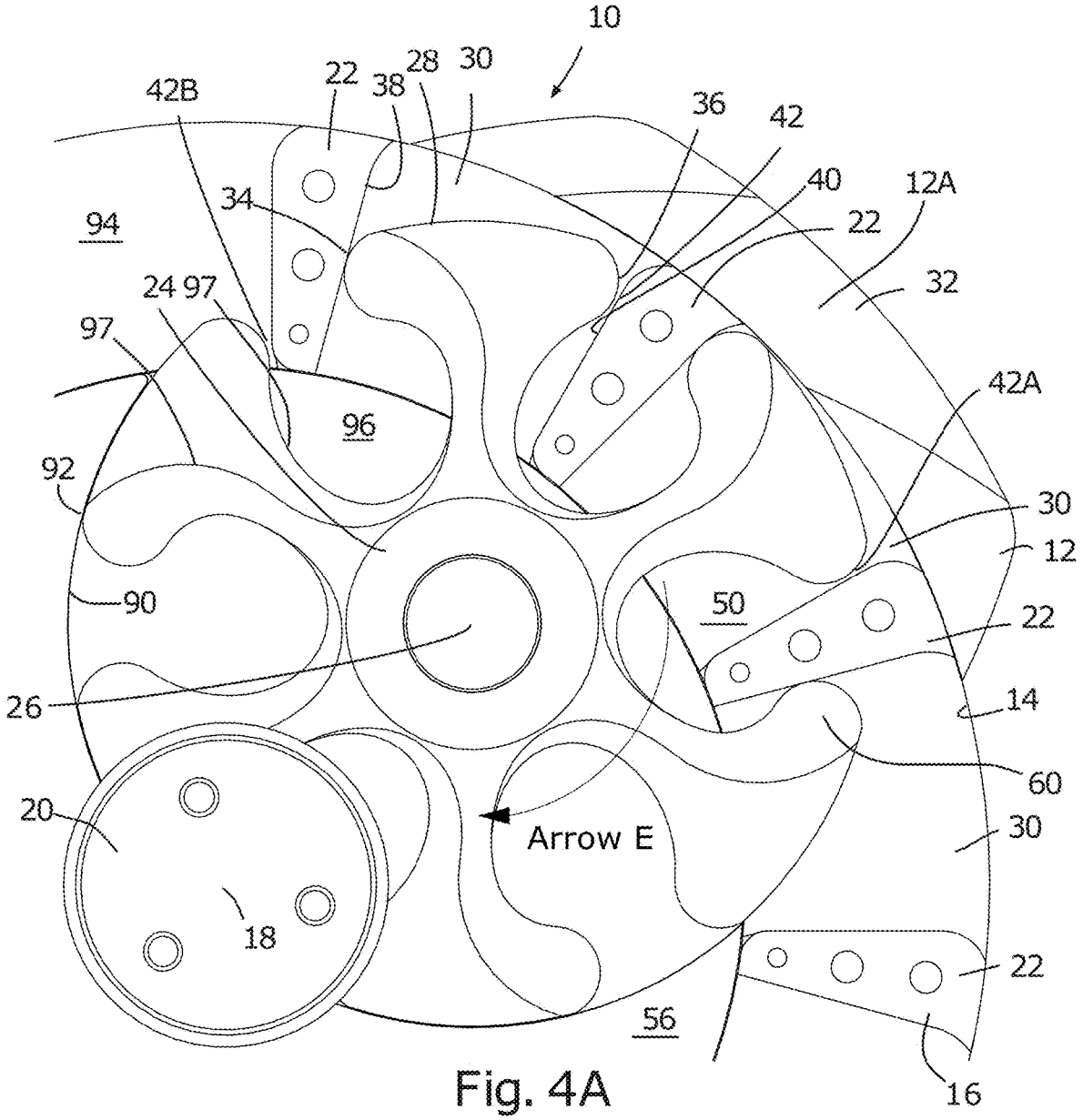
Figure 4B:
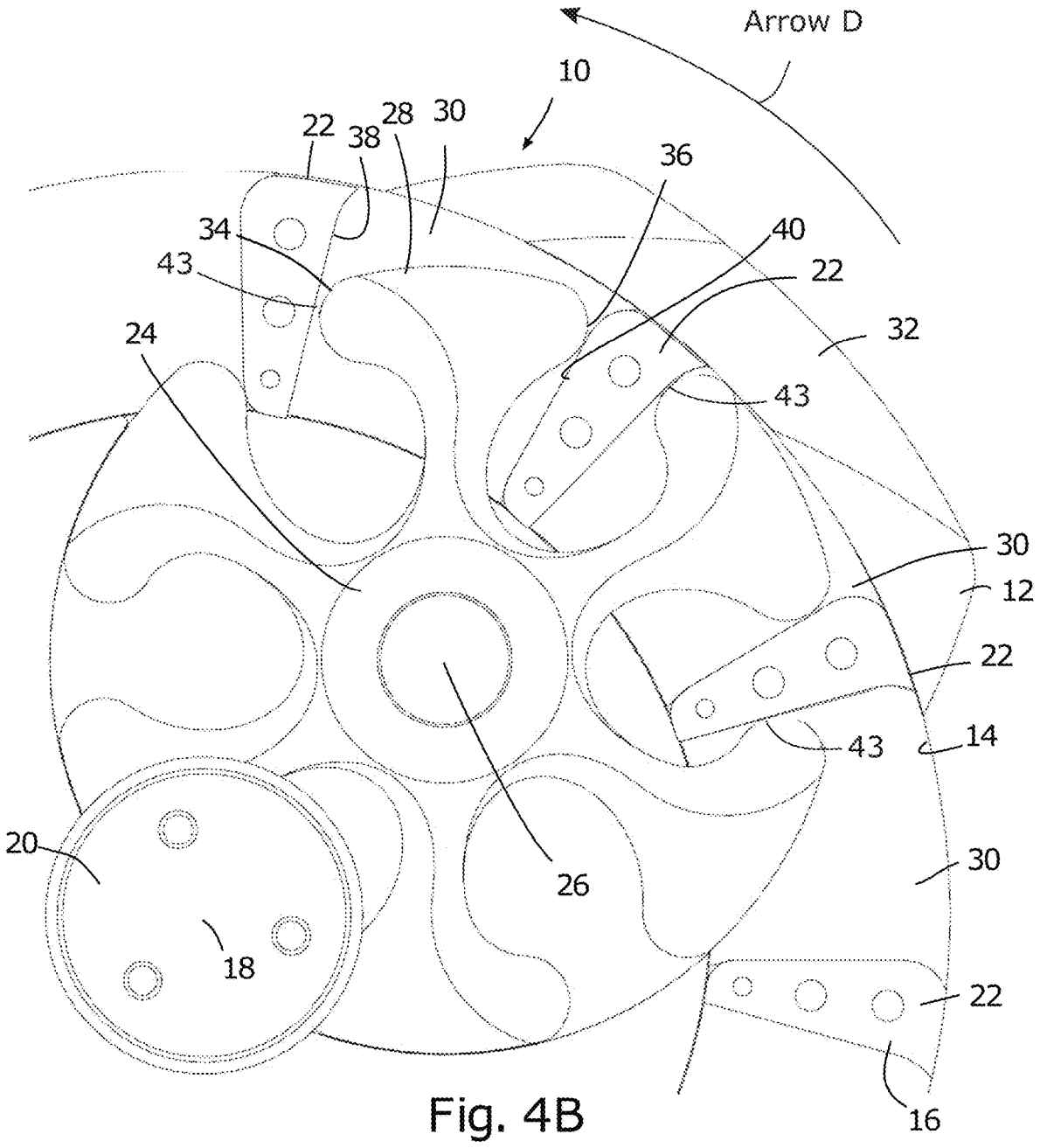
FIG. 4B is a simplified top view of an embodiment of the present invention with no casing (fasteners not shown in any views), where the outer rotor is driven in an opposed direction to the direction shown in FIG. 4A.

As better seen in FIG. 1B, each outward projection 28 has a first sealing surface 34 and a second sealing surface 36 circumferentially opposed to each other for respective engagement with corresponding sealing surfaces 38, 40 of adjacent inward projections 22. In an operational configuration in which the outer rotor 16 is driven in a first direction shown by the arrow A in FIG. 1, the first sealing surface 34 seals against a first corresponding inward projection 22 with a first gap 42 between at least part of the second sealing surface 36 and the sealing surface 40 of the second corresponding inward projection 22. As shown in FIG. 4B, when the outer rotor 16 is driven in a second direction shown by arrow D opposed to the first direction A, the second sealing surface 36 seals against the second corresponding inward projection 22 with a second gap 43 between at least part of the first sealing surface 34 and the sealing surface 38 of the first corresponding inward projection 22.

The gap is explained further as follows with reference to FIGS. 1A, 1B and 1C. At a reference plane along the width of the inner and outer rotor, the first sealing surface 34 of the inner rotor 24 is an arc; and the sealing surface 38 of the outer rotor 16 is a line which is offset from a line 25 radiating from the rotational center 23 of the outer rotor 16 by the radius length R of the first sealing surface 34 of the inner rotor. At the same or different reference plane along the width of the inner rotor 24 and outer rotor 16, the second sealing surface 36 of the inner rotor 24 is an arc; and the sealing surface 40 of the outer rotor 16 is a line which is offset from a line radiating from the rotational center 23 of the outer rotor 16 by the radius length R of the first sealing surface 34 of the inner rotor 24. A gap is provided between one of the sealing surfaces 34, 36 of the outward projections 28 as the outward projections move within the chambers 30. With an inner rotor 24 of the type shown in FIG. 9 and FIG. 1B, the gap is continuous across the width of the outward projection 28. Thus, in one example a non-sealing gap 42, as shown in FIG. 4A, exists along the entire width of the inner rotor 24. FIG. 4A also shows gaps 42A and 42B for different projections at different degrees of rotation. In another embodiment, shown in FIG. 1C, a part of the second sealing surface 36A of the outward projection 28A contacts the sealing surface 40 when the inner rotor first sealing surface 34 contacts sealing surface 38. In this configuration, a flow path or relief 39, of the type shown also in FIG. 10 or could be of the type shown in FIG. 8 or other possibilities and a non: sealing gap exists for part of the width of the inner rotor as the outward projections moves in the chamber 30. In a third option, shown in FIGS. 1-4A for example, a variable width continuous gap exists.

"non sealing" is preferably defined as a large enough gap for enough of the width of the inner rotor that the pressure which equalizes across this restriction is adequate to keep the trailing face of the inner rotor in acceptable sealing proximity to the leading sealing face of the outer rotor at the maximum design speed, pressure and fluid viscosity of the pump. For an inner rotor diameter of 2", this has been shown to be preferably at 0.1" or more for at least 50% of the width of the inner rotor with water at 1800 rpm and 100 psi, but greater or lesser gaps can be used with different effects.

Figure 1A:
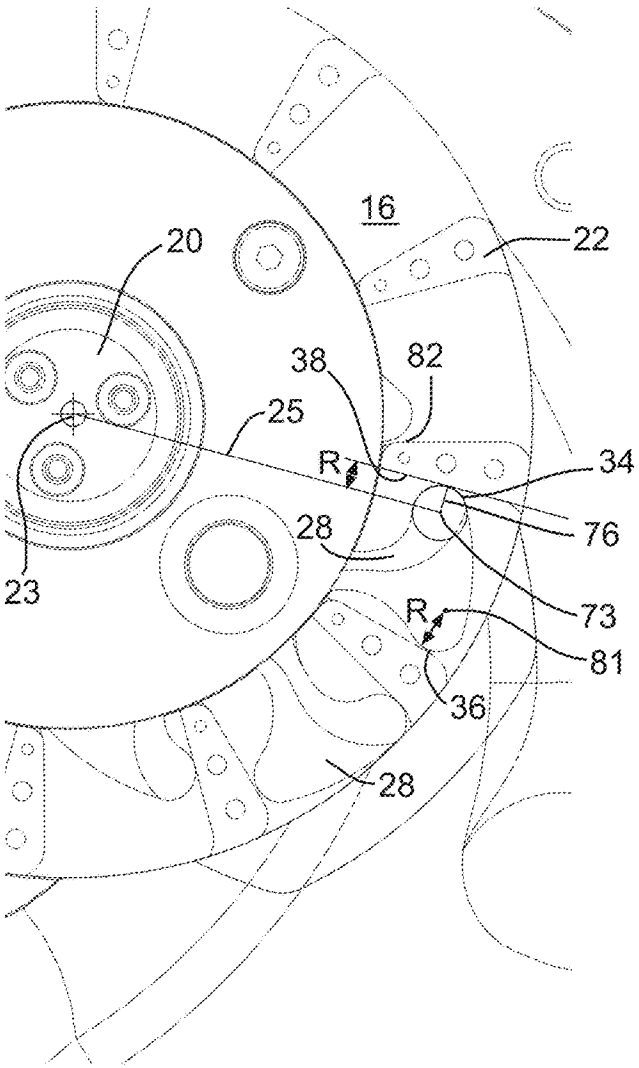
Figure 1C:
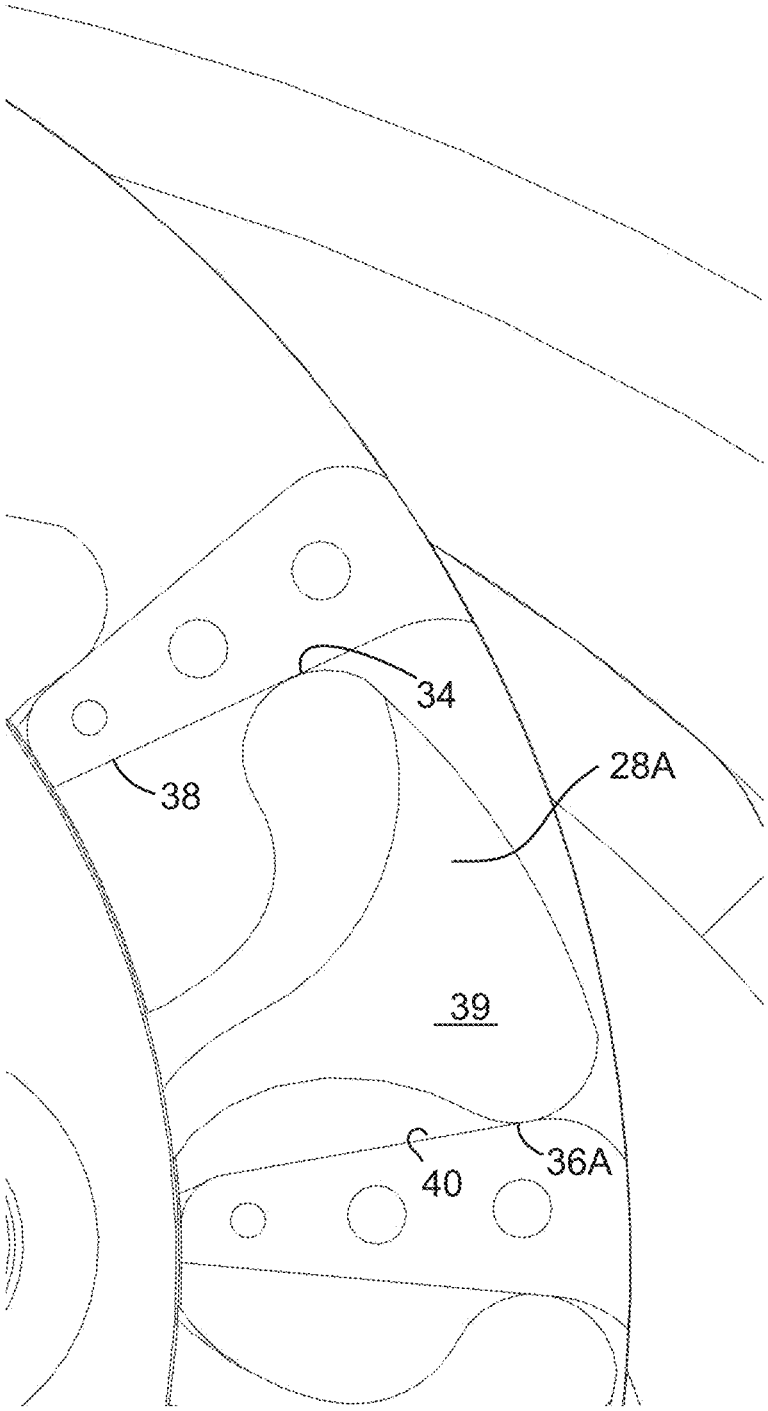

As seen in FIG. 1A, line 25 extends radially from center point 23 of the outer rotor 16 through point 73 located on the trailing portion of outward projections 28 of the inner rotor 24. The first sealing surface 34 is a semi-circle in the lateral plane defined by a radius 76 about point 73. As the point 73 travels radially outward along line 25 away from the center of the outer rotor 16, the first sealing surface 34 will maintain contact along sealing surface 38 because this surface is perpendicular to line 76. The same analysis can be conducted for all of the inward projections 22 with the respective outward projections 28.

It should be noted that the preferred surface for an embodiment for first sealing surface 34 is a semicircle about point 73. The preferred shape of second sealing surface 36 for at least part of the width of the outward projection 28, is also a semicircle about point 81. These semicircular shapes for first sealing surface 34 and second sealing surface 36 allow the inward projections 22 to have sealing surfaces 38, 82 that are offset from the radial line 25 by a distance equal to the length of line 76.

For this geometry to provide a seal between first sealing surface 34 and sealing surface 38, the ratio between the number of inward projections 22 and outward projections 28 must be two to one.

The housing includes an inward facing surface 90 of revolution defined by the outermost surface 92 of the outward projections 28 of the inner rotor 24. This internal surface 90 provides a seal between the outward projections 28 of the inner rotor 24 and the inward facing surface of the housing 12 such that a seal is maintained at all times in this area between the high pressure side of the pump and the low pressure side of the pump. This seal is a greater radial distance from the center of the inner rotor than the seal between the first sealing surface 34 of the inner rotor projection trailing surface seal with outer rotor sealing surfaces sealing surfaces 38. As a result, the high pressure fluid on the discharge side 94 of the pump acts on a greater surface area 97 of the inner rotor 24 to generate a torque in the opposite direction of inner rotor rotation than the torque on the inner rotor resulting from the surface area 96 of the inner rotor 24 exposed to the high pressure fluid which results in a torque on the inner rotor 24 in the same direction of rotation. This provides enough contact pressure between the rotors to create a seal but not enough, in many applications, to result in a high level of wear.

Port are sealed from each other by the OD of the outer rotor and ID of the housing, the seal between the inner and outer rotors, and the seal between the inner rotor OD and the housing. The seal between the inner rotor OD and the housing may comprise a sealing surface fixed to the housing in sealing proximity to the outward facing surface of the inner rotor over a portion of the circumference of the inner rotor inward of the inward projections. There are also side seals which also contribute to sealing the inlet port from the outer port and from the outside of the device.

Figure 7:
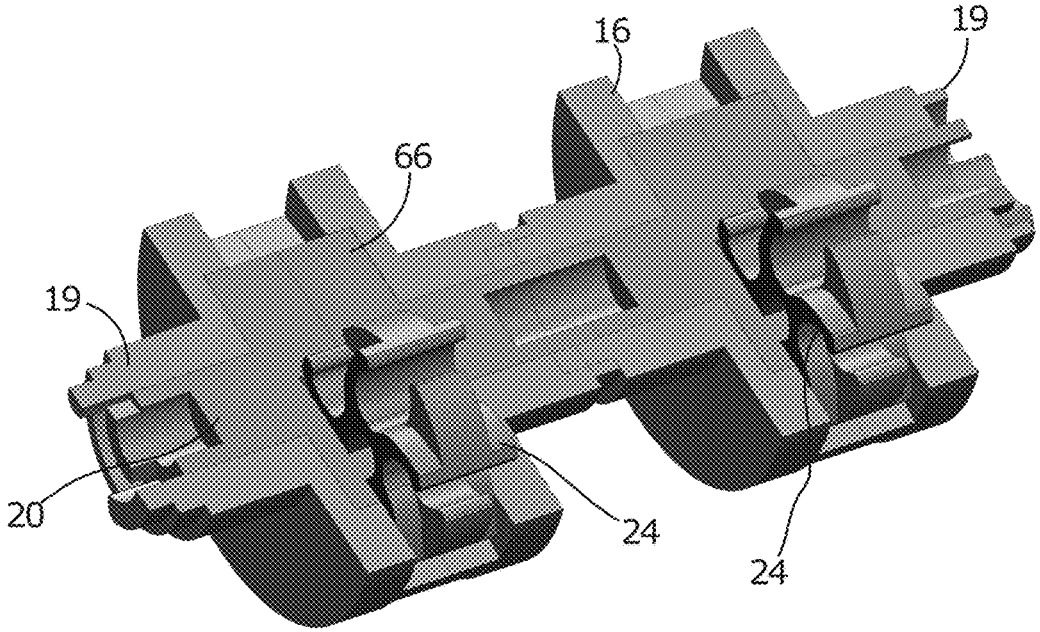
FIG. 7 is a simplified schematic iso section view of an embodiment of the present invention showing coaxial multi stage configuration (no casing shown)
Figure 8:
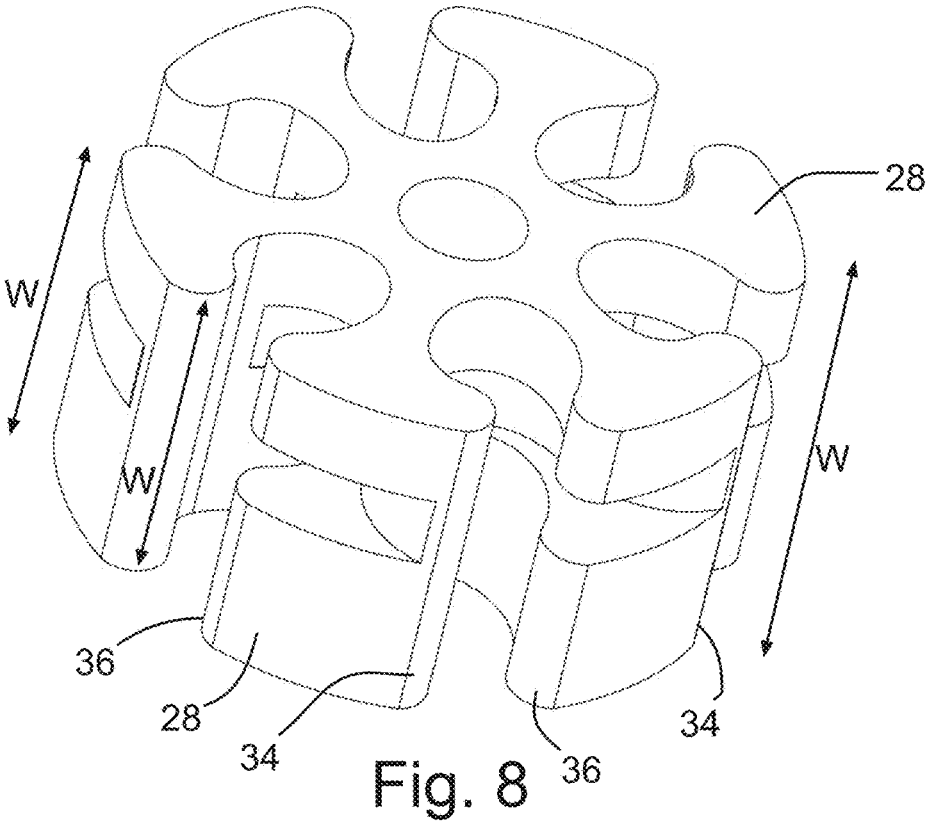
FIG. 8 shows an embodiment of an inner rotor with a discontinuous sealing surface (laterally variable gap)
Figure 9:
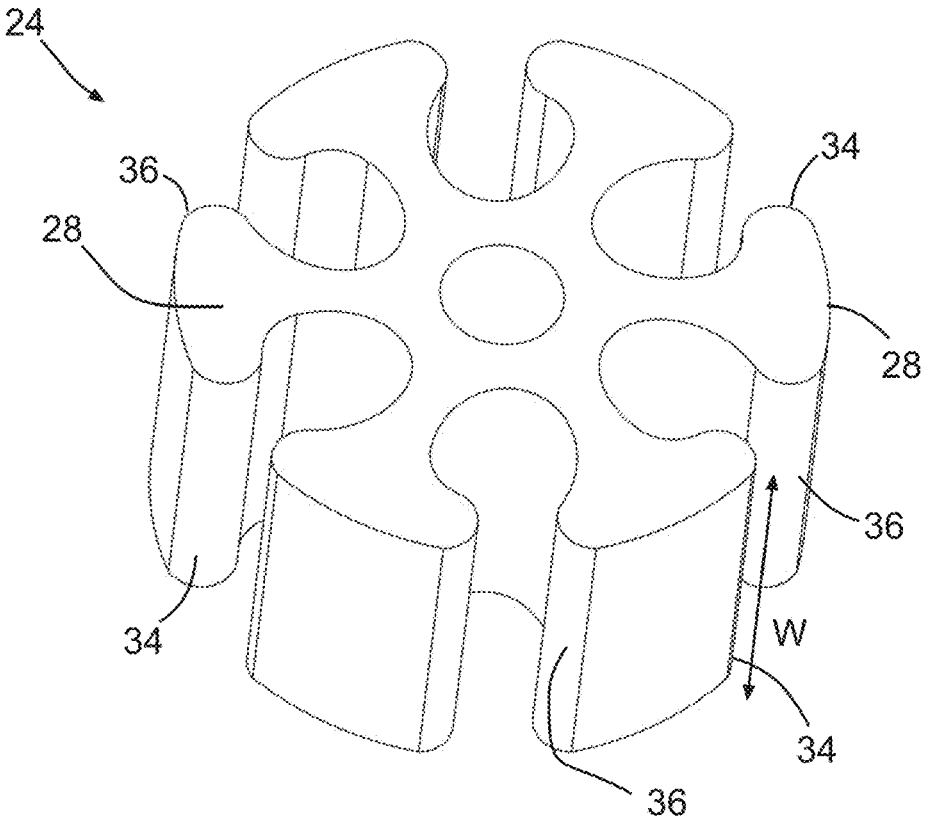
FIG. 9 shows an embodiment of an inner rotor with continuous sealing surface.

As seen in FIG. 8, in an embodiment each outward projection 28 has a lateral width W, and one of the first sealing surface 34 and the second sealing surface 36 of each outward projection 28 (here the second sealing surface 36) is discontinuous across the lateral width of the outward projection 28 to provide a flow path for enhanced pumping of entrapped gases. Another embodiment of the discontinuous sealing surfaces is shown in FIG. 7. The discontinuity may be provided on one side only of the lateral width W. As shown in FIG. 9, the sealing surfaces 34, 36 may also be continuous in some embodiments.

The first gap 42 may extend along a first path defined by the second sealing surface 36 as the corresponding outward projection 28 moves in relation to the second corresponding inward projection 22 and the first gap has uniform width along the first path as illustrated by the gaps 42, 42A and 42B.

Likewise, the second gap may extend along a second path defined by the first sealing surface as the corresponding outward projection moves in relation to the first corresponding inward projection and the second gap has uniform width along the second path.

As shown in FIG. 7, a drive shaft 19 may be coupled to one or more outer rotors 16 of corresponding fluid transfer devices of the same design. The drive shaft may have opposed ends and be supported at the opposed ends by the housing.

Figure 5:
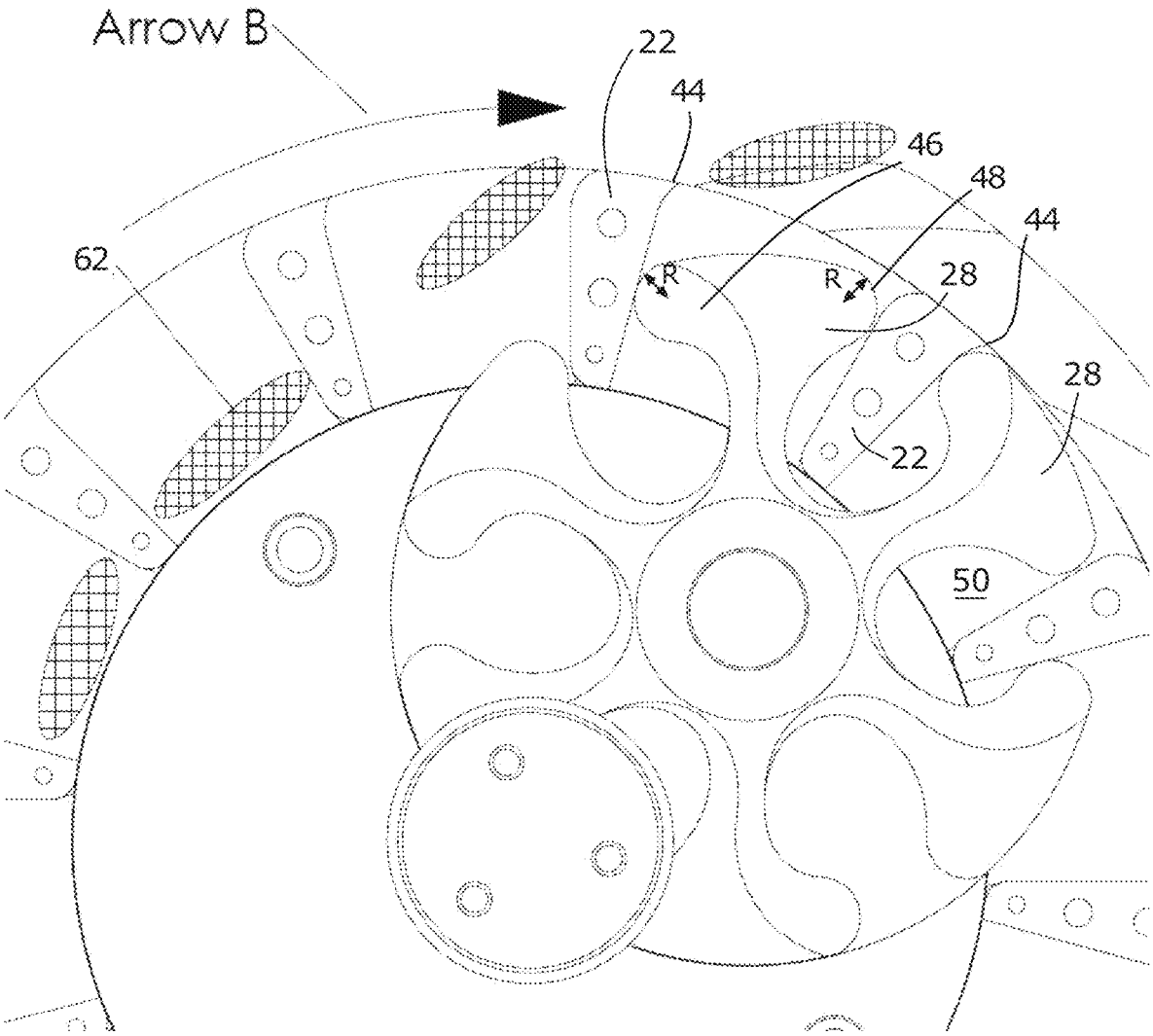
FIG. 5 is a simplified schematic bottom view of the discharge port of an embodiment of the present invention with no casing showing entrained gas handling capability (when inner rotor foot enters the chamber, the acceleration on the fluid is in the opposite direction and all or part of the lighter gas is pushed out of the chamber first)

As indicated in FIG. 5, the fluid transfer device may have inward projections 22 with a sharp edge 44 facing in a direction of travel at a radially outward part of the inward projection 22. The fluid transfer passages 32 may be curved to centrifuge heavier materials to an outer portion of the fluid transfer passages 32. As seen in FIG. 5, the outward projections 28 may terminate outwardly in lobes 46, 48 having a radius R. Each inward projection 22 may have a surface S offset from a radial line L from the outer rotor axis equal to the lobe radius R of the sealing surfaces 34, 36 formed by lobes 46, 48.

Referring to FIG. 1-4, when used as a pump with direction of rotation as shown in FIG. 1, the larger outer rotor 16 is driven with a rotary shaft input, and only the convex first sealing surface 34 of the inner rotor 24 contact the flat (or substantially flat) sealing surfaces 38 of the outer rotor "cylinder" walls. The second sealing surface 36 of each inner rotor foot of the outward projection does not seal and can be any shape as long as it prevents the rotors from locking up when the pump is freespinning or backturning. In a preferred embodiment, the sealing surfaces 34, 36 are radiused and have a line contact with the sealing surfaces 38, 40 of the inward projections 22, when in contact with the sealing surfaces 38, 40, which depends on the direction of motion of the outer rotor 16.

Benefits of this design include the ability of the inner rotor to rotationally "retreat" (as opposed to the more commonly used term "advance") in relation to the outer rotor 16 as the inner rotor 24 and/or outer rotor sealing surfaces 34, 36, 38, 40 wear. This will, in effect, allow the pump to "wear in" for a period of time rather than wear out.

Other advantages of driving the outer rotor 16 include the ability to drive subsequent stages with a drive shaft 19 that extends from both ends of one or more outer rotors 16 to drive multiple similarly constructed outer rotors 16, as shown in FIG. 7. A coaxial stator shaft 20 through the center of the drive shaft would be supported (at the opposite end from the drive shaft input) to the pump casing and would prevent the inner rotor housings from spinning. The inner rotor 24 may be secured to prevent movement in relation to the housing by the stator shaft 20.

As Ice Pump

In one configuration of the pump, it is designed to handle the admission and pumping of breakable solids such as but not limited to methane hydrate ice crystals. It does this with a combination of features such as sharp leading edges (for example, item 44) on spinning components and sharp trailing edges on stationary components which will slice the ice as it flows into and through the pump. It is also designed to minimized areas where ice could become wedged and restrict the flow by using increasing cross sections along the flow path (passages 32 for example).

As Hydraulic Motor

By providing fluid pressure to the outlet port of the pump configuration described above and shown in the drawings, the device can also be used in reverse rotation as a hydraulic motor. In this case, the leading convex edges of the second sealing surfaces 36 of the inner rotor feet contact the flat or substantially flat sealing surface 40 of the outer rotor 16 which drives the output shaft.

As Multi Phase Pump

The pump is ideally suited to pump gases entrapped in a compressible fluid as follows: Gas bubbles that enter the pump will be centrifuged to the innermost area 50 (FIG. 5) of each outer rotor cylinder chamber 30. When the outward projections 28 rapidly enters the chamber in the discharge port zone 33 (FIG. 1), it will create an acceleration force on the fluid which is in the opposite direction of the centrifugal force on the fluid up to that point. This is expected to cause the higher density fluid to swap positions with at least some of the entrained gas, effectively pushing a bubble of gas out ahead of the fluid as it exits the chamber. In a gas compatible design, the rotational axis is preferably (but not necessarily) vertical and the inner rotor 24 has a flow relief (which exists between the first sealing surfaces 34 of each subsequent inner rotor foot) only on the bottom of the inner rotor 24 so gravity can bias the gas to the top of the chamber as it moves from the input to the output area of the pump. The top sealing surface of the inner rotor 24 is therefore more adequately sealed against gas leakage and is believed to be capable of pushing at least part of the entrained gas out of each chamber.

In the case of entrained gas, it may be preferable to not push all of the gas out of the chamber at once. This will reduce torque and pressure variations for smoother operation and longer service life.

Figure 6:
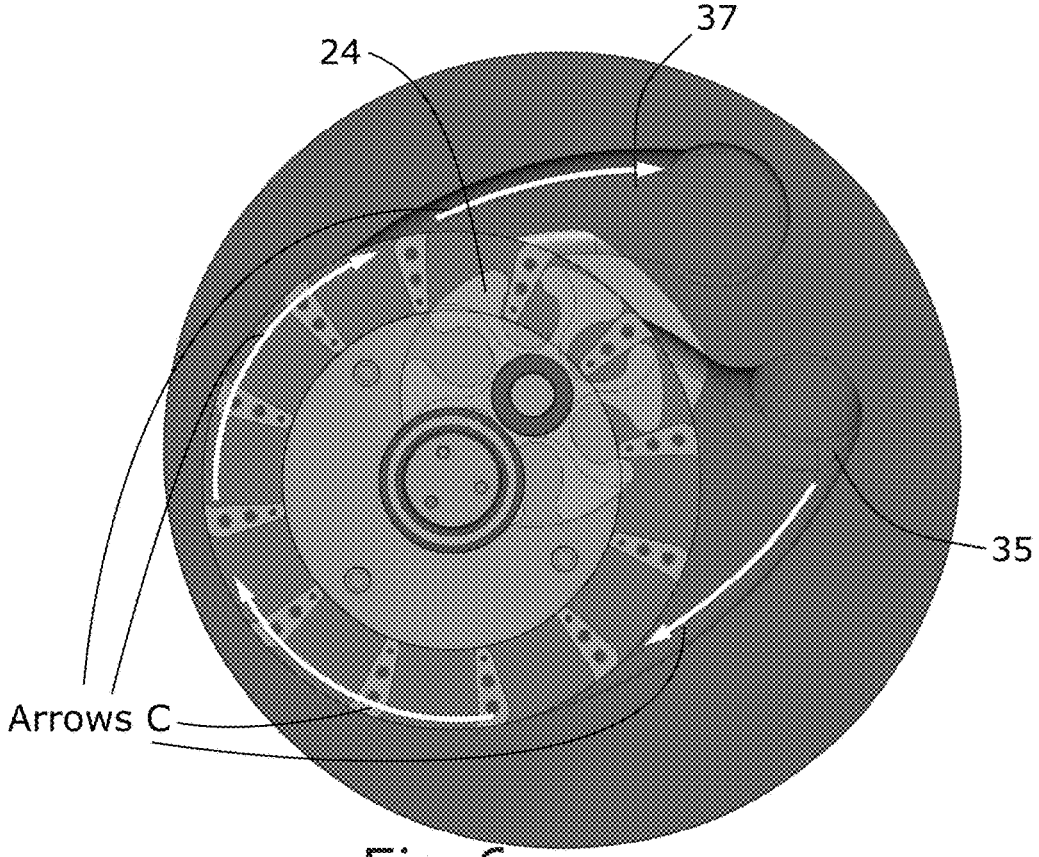
FIG. 6 is a simplified top view of an embodiment of the present invention with bottom casing only, the casing showing entrained sand handling capability (with white arrows C showing a path of denser particles that enter the pump on a helical path and are biased away from the inner rotor sliding interface by centripetal force)

As shown in FIG. 6, the pump is also ideally suited to pump grit such as sand. In this case, the port 35 leading up to a pumping stage is preferably curved along an arced or helical path to centrifuge the heavier sand to the outer surface of the flow path. The will bias the sand away from the intake rotor sliding interaction. The sand then travels around the outer perimeter of the casing (arrows C) and cylinder volume to the discharge port 37 where centripetal force ejects and biases it away from the rotor sliding interaction.

The multiple seal of the cylinder wall outer surfaces and casing wall inner surface allows the perimeter area (where the sand will be sliding) to have a larger gap clearance while still preventing high leakage rates.

Many other configurations of the pump described here are possible and conceived by the inventor. Various features and advantages of the pump design are shown in the figures as described below.

FIG. 1 shows metal inserts 54 in plastic prototype casing are sharp on trailing edges to slice entrained ice. Arrow A shows the rotational direction of rotors when operated as a pump. As a hydraulic motor, the rotation would be in the opposite direction.

Figure 2:
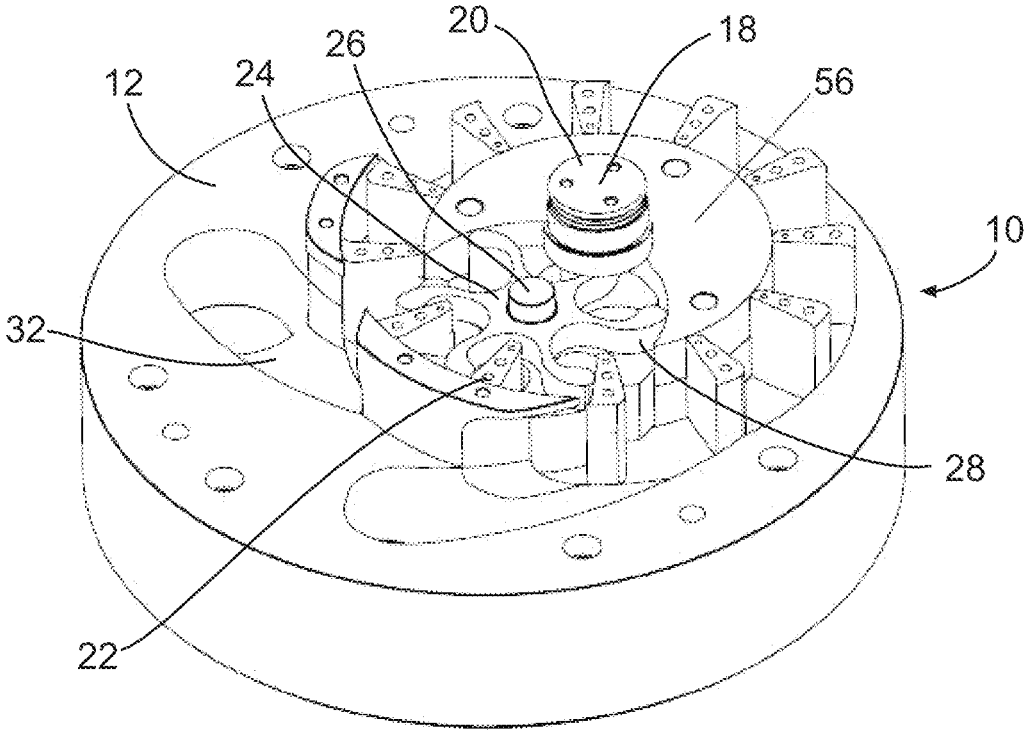
FIG. 2 is a simplified iso view of an embodiment of the present invention with no top casing.

In FIG. 2 shows inner crescent 56 is held from rotating by shaft 20 and provides bearing position for inner rotor 24.

Figure 3:
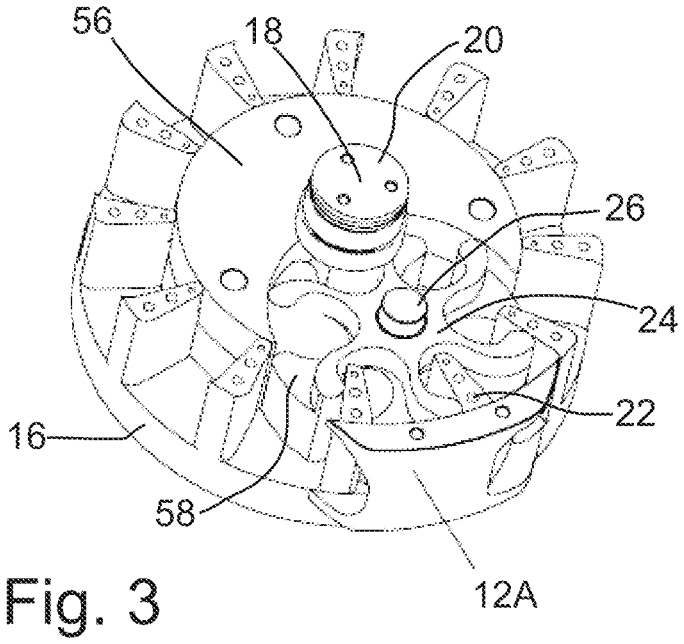
FIG. 3 is a simplified iso view of an embodiment of the present invention with no casing.

In FIG. 3 a relief 58 cut on inner rotor 24 allows second sealing surface 36 of inner rotor 24 to remain unsealed.

In FIG. 4A the inner crescent 56 is held from rotating by shaft 20 and provides bearing position for inner rotor 24. First sealing surface 34 of driven inner rotor 24 seals against sealing surface 38 of driving outer rotor 16. Sealing surface 38 of outer rotor 16 are sharp to break/slice/crush ice that enters the pump. Convex second sealing surface 36 of outward projections 28 does not seal against sealing surface 40 of inward projections 22. Sealed housing section 12A is provided between intake and discharge. Extra material 60 on first sealing surface 34 of inner rotor 24 maintains seal integrity as it wears. Arrow E shows the direction of rotation of inner rotor 24 when the outer rotor 16 rotates as shown by arrow A in FIG. 1.

As shown in FIG. 5, entrained gas 62 is centrifuged toward inside of outer rotor cylinders. When an inner rotor foot enters the chamber, the acceleration on the fluid is in the opposite direction and all or part of the lighter gas is pushed out of the chamber first. Arrow B shows the direction of rotation of outer rotor 16.

In FIG. 6, arrows C show the path of denser particles that enter the pump at preferably helical intake 35 on a helical path and are biased away from the inner rotor 24 sliding interface by centripedal force.

In FIG. 7 the casing is not shown. Drive torque from the motor or shaft is provided to drive shaft 19 which rotates and transmits torque to outer rotor 16 of next stage. Inner coaxial shaft 20 is secured to casing at opposite end from drive input and prevents inner members 66 (which position inner rotors 24) from turning.

The housing surface of revolution may be a conical or cylindrical or partially cylindrical surface. The outer rotor rotates around a shaft that defines the axis of rotation of the outer rotor and the shaft is fixed in relation to the housing, by any suitable means, including the shaft being secured by one or both of its ends to a portion of the housing or a carrier or other intermediate part or parts that ultimately connect to the housing.

The outer rotor has radially inward projections, each having a trailing face and leading face. The leading face may be, along any plane perpendicular to the outer rotor axis, offset from a radial line radiating from the outer rotor rotational axis as disclosed for example in U.S. Pat. No. 7,111,606. The outer rotor may be connected to be driven with a rotary shaft input. In another embodiment, convex trailing contact surfaces of the outward projections of the inner rotor contact the leading contact surfaces of the inward projections, the leading surface of each inner rotor outward projection does not seal and can be any shape as long as it prevents the rotors from locking up when the pump is freespinning or backturning. For establishing the gaps disclosed between the sealing surfaces of the inward projections and the outward projections, the paths of the sealing surfaces of the outward projections may first be analyzed and then the contour of the sealing surfaces of the inward projections machined to generate the gaps. Alternatively, for example, the contour of the inward projections may be computed from the geometry of the outward projections, the inner rotor and the outer rotor as disclosed for example in U.S. Pat. No. 7,111,606. The fluid transfer pump may be used to pump breakable solids such as but not limited to methane hydrate ice crystals, for example with one or more features such as sharp leading edges on spinning components and sharp trailing edges on stationary components which will slice the breakable solids, for example ice, as it flows into and through the pump. It is also designed to minimize areas where ice could become wedged and restrict the flow by using increasing cross sections along the flow path. In an embodiment, by providing fluid pressure to the outlet port of the pump configuration described above and shown in the drawings, the device can also be used in reverse rotation as a hydraulic motor. In this case, the leading convex edges of the inner rotor feet contact the flat or substantially flat trailing surface of the outer rotor which drives the output shaft. The respective gaps on either side of each outward projection, depending on whether the outer rotor is driven normally or in reverse are preferably relatively small to provide a proximity seal.

As shown in FIG. 5, the fluid transfer device is ideally suited to pump gases entrapped in a compressible fluid as follows: Gas bubbles 62 that enter the pump are centrifuged to the innermost area of each outer rotor cylinder chamber; When the inner rotor foot rapidly enters the chamber in the discharge port zone, it will create an acceleration force on the fluid which is in the opposite direction of the centrifugal force on the fluid up to that point; This causes the higher density fluid to swap radial positions with at least some of the entrained gas, effectively pushing a bubble of gas out ahead of (radially outward from) the fluid as it exits the rotating chamber. The flow reliefs on the inner rotor are shown as being on the bottom but may be top, bottom or center.

In a gas compatible design the flow relief may be asymmetrical, on one side only of each inward projection. The rotational axis of the inner rotor is preferably (but not necessarily) vertical and the inner rotor has a flow relief (which exists between the leading convex contact surfaces of each subsequent inner rotor foot) only on the bottom of the inner rotor so gravity can bias the higher density liquid to the bottom of the chamber and the gas to the top of the rotating chamber as it moves from the input to the output area of the pump; the top sealing surface of the inner rotor is therefore more adequately sealed against gas leakage (by virtue of it spanning a greater circumferential span of the chamber) and is capable of pushing at least part of the entrained gas out of each chamber during each rotation.

In the case of entrained gas, it is preferable to not push all of the gas out of the chamber at once, this will reduce input torque and pressure variations for smoother operation and longer service life. This can be achieved by the discontinuous sealing surface.

The pump is also ideally suited to pump grit such as sand. In this case, the port leading up to a pumping stage is preferably curved along an arced or helical path to centrifuge the heavier sand to the outer surface of the flow path. The will bias the higher density sand and/or other abrasives away from the intake rotor sliding interaction with the outer rotor. The sand then travels around the outer perimeter of the casing and cylinder volume to the discharge port where centripetal force ejects and biases it away from the rotor sliding interaction. The multiple seal of the cylinder wall outer surfaces and casing wall inner surface allows the perimeter area (where the sand will be sliding) to have a larger gap clearance while still preventing high leakage rates.

In another embodiment, the radius of the trailing convex surface on the inner rotor is substantially equal to the offset distance of the leading face of the radial projections on the outer rotor from the radial line from the axis of the outer rotor.

In another embodiment, the outward projections of the inner rotor each having a leading surface and trailing surface and the leading surface of the inner rotor projections has a larger gap clearance than the trailing surface such that fluid pressure is allowed to communicate with the chamber ahead of it.

In another embodiment, the leading surface of the inner rotor projections has a larger gap clearance than the trailing surface such that fluid pressure is allowed to communicate with the chamber ahead of it up to the contact between the trailing convex surface of the preceding inner rotor projection contact with the leading offset radial surface of the preceding radial projection of the outer rotor.

In another embodiment, the outer surface of each projection of the inner rotor is at least partially substantially circular along any plane perpendicular to the center axis of the inner rotor and in sealing proximity to the inward facing surface of the carrier for part of the rotation.

Preferably, the forward-most leading convex surface of the inner rotor has a consistent gap through a portion of the rotation such that rotation of the outer rotor at a constant speed with the leading surface of the inner rotor in contact with the trailing surface of the outer rotor inward projection would allow/cause the inner rotor to rotate at a constant speed. This geometry would allow reverse operation and also defines a consistent gap clearance that will provide enough of a "seal" (even though it is a gap, it will still serve to push the gas in front of the inner rotor foot if the air is restricted from going anywhere else) to eject entrained gas from the pump. In an embodiment, the variable volume chambers may be partially defined by planar side faces of the outer rotor or by planar faces of the outer rotor on both axial ends of the inner rotor/s.

Figure 11:
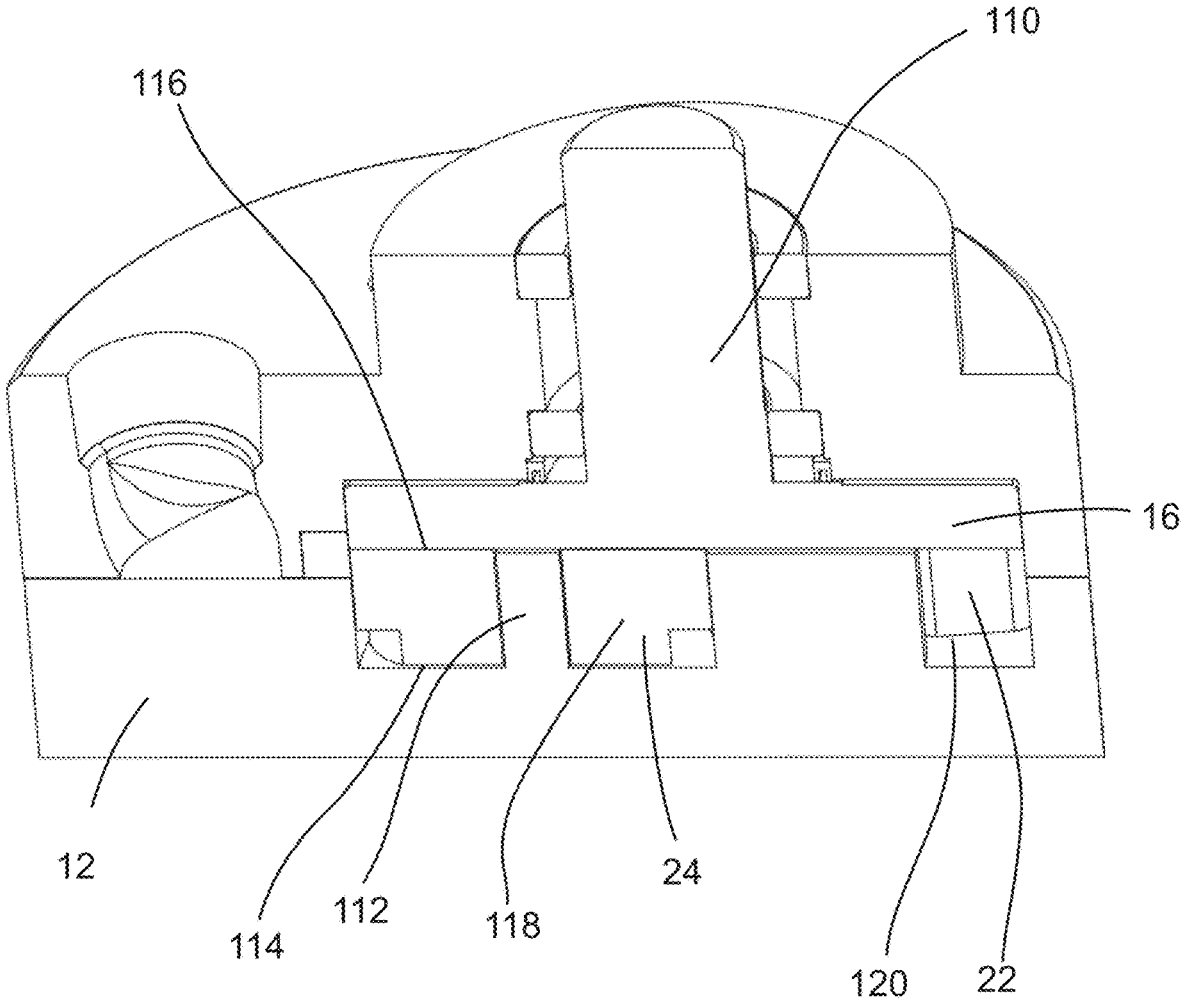
FIG. 11 shows a section through another embodiment of a fluid transfer device.

In a further embodiment shown in FIG. 11, an outer rotor 16 is supported by a cantilevered shaft 110 and an inner rotor 24 is supported by a cantilevered shaft 112. The outer rotor has inward projections 120 that are sealed against housing 12 on one side 122. Inner rotor side faces 118 are sealed against housing 12 on one side 114 and against outer rotor 16 on the other side 116. Outer rotor, cantilevered shaft 110 and inward projections may be a contiguous unit.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

What is claimed is:

1. A fluid transfer device comprising:

a housing having an inward facing surface;

an outer rotor secured for rotation about an outer rotor axis that is fixed in relation to the housing, the outer rotor having inward projections, the outer rotor being arranged to be driven in operation by a drive shaft;

an inner rotor secured for rotation about an inner rotor axis that is fixed in relation to the housing, the inner rotor axis being inside the outer rotor, the inner rotor having outward projections, the outward projections in operation meshing with the inward projections to define variable volume chambers as the inner rotor and outer rotor rotate; fluid transfer passages in a portion of the housing to permit flow of fluid into and out of the variable volume chambers; and each outward projection having a first sealing surface and a second sealing surface circumferentially opposed to each other for respective engagement with corresponding sealing surfaces of adjacent inward projections such that in an operational configuration in which the outer rotor is driven in a first direction, over at least a portion of a range of travel of the outer rotor the first sealing surface seals against a first corresponding inward projection with a first gap between at least part of the second sealing surface and a second corresponding inward projection and when the outer rotor is driven in a second direction opposed to the first direction, over the same portion of the range of travel of the outer rotor the second sealing surface seals against the second corresponding inward projection with a second gap between at least part of the first sealing surface and the first corresponding inward projection.

2. The fluid transfer device of claim 1 in which, in respect of each outward projection, the first gap extends along a first path defined by the second sealing surface as the outward projection moves in relation to the second corresponding inward projection and the first gap has uniform width along the first path.

3. The fluid transfer device of claim 1 in which, in respect of each outward projection, the second gap extends along a second path defined by the first sealing surface as the outward projection moves in relation to the first corresponding inward projection and the second gap has uniform width along the second path.

4. The fluid transfer device of claim 1 in which the drive shaft is coupled to one or more outer rotors of corresponding fluid transfer devices.

5. The fluid transfer device of claim 1 in which the drive shaft has opposed ends and is supported at the opposed ends by the housing.

6. The fluid transfer device of claim 1 in which each inward projection includes a sharp edge facing in a direction of travel at a radially outward part of the inward projection.

7. The fluid transfer device of claim 1 in which the fluid transfer passages are curved to centrifuge heavier materials to an outer portion of the fluid transfer passages.

8. The fluid transfer device of claim 1 in which each of the first sealing surfaces comprises a lobe having a lobe radius.

9. The fluid transfer device of claim 8 in which each inward projection has a surface offset from a radial line from the outer rotor axis equal to the lobe radius of the first sealing surface.

10. Use of the fluid transfer device of claim 1 to pump breakable solids.

11. The use as claimed in claim 10 in which the breakable solids are ice.

* * * * *